US010247059B2

(12) United States Patent
Bayrakdar

(10) Patent No.: US 10,247,059 B2
(45) Date of Patent: Apr. 2, 2019

(54) CAMSHAFT ADJUSTER

(71) Applicant: Schaeffler Technologies AG & Co. KG, Herzogenaurach (DE)

(72) Inventor: Ali Bayrakdar, Roethenbach/Pegnitz (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 15/510,496

(22) PCT Filed: Jun. 18, 2015

(86) PCT No.: PCT/DE2015/200377

§ 371 (c)(1),
(2) Date: Mar. 10, 2017

(87) PCT Pub. No.: WO2016/037616

PCT Pub. Date: Mar. 17, 2016

(65) Prior Publication Data

US 2017/0254233 A1 Sep. 7, 2017

(30) Foreign Application Priority Data

Sep. 12, 2014 (DE) ..... 10 2014 218 320
Oct. 2, 2014 (DE) ..... 10 2014 219 990

(51) Int. Cl.
*F01L 1/34* (2006.01)
*F01L 1/344* (2006.01)
(Continued)

(52) U.S. Cl.
CPC ..... *F01L 1/3442* (2013.01); *F01L 1/348* (2013.01); *F01L 1/34409* (2013.01);
(Continued)

(58) Field of Classification Search
CPC ..... F01L 1/3442; F01L 1/34409; F01L 1/348; F01L 1/344; F01L 1/047; F01L 2001/34433
See application file for complete search history.

(56) References Cited

U.S. PATENT DOCUMENTS 9,422,838 B2 8/2016 Kohler et al.
9,534,514 B2 1/2017 Bayrakdar et al.
(Continued)

FOREIGN PATENT DOCUMENTS

CN 102606250 7/2012
DE 102006008861 8/2007
(Continued)

OTHER PUBLICATIONS

International Search Report of PCT/DE2015/200377, 2 pages, dated Nov. 12, 2015.

*Primary Examiner* — Zelalem Eshete
(74) *Attorney, Agent, or Firm* — Davidson, Davidson & Kappel, LLC

(57) ABSTRACT

A camshaft adjuster (1) for driving and/or adjusting a camshaft (2) of an internal combustion engine, including a stator (3) and a concentric rotor (6) which is arranged within the stator in a rotatable manner. At least the stator (3) has a central receiving area (31) for receiving the camshaft (2), and at least one projection (13) which protrudes radially inwards is provided on a radial inner edge (12) of the central receiving area (31) in order to engage behind a camshaft (2) connecting piece (20) which protrudes radially outwards. A camshaft adjuster/camshaft combination (26) including such a camshaft adjuster (1) and a camshaft (2) which has a connecting piece (20) that projects radially. The projection (13) preferably engages behind the connecting piece (20). A
(Continued)

method for assembling the camshaft adjuster/camshaft combination (26) is also provided.

19 Claims, 4 Drawing Sheets

(51) Int. Cl.
*F01L 1/348* (2006.01)
*F01L 1/047* (2006.01)

(52) U.S. Cl.
CPC ..... *F01L 1/047* (2013.01); *F01L 1/344* (2013.01); *F01L 2001/34433* (2013.01)

(56) References Cited

U.S. PATENT DOCUMENTS

| | | | | |
|---|---|---|---|---|
| 2005/0045130 | A1 | 3/2005 | White et al. | |
| 2008/0236529 | A1* | 10/2008 | Scheidig ..... | F01L 1/34 123/90.17 |
| 2014/0165938 | A1 | 6/2014 | Kawada et al. | |

FOREIGN PATENT DOCUMENTS

| | | |
|---|---|---|
| DE | 10 2011 082590 | 3/2013 |
| DE | 102012218802 | 4/2014 |
| DE | 10 2012 223582 | 6/2014 |
| DE | 102013101255 | 8/2014 |
| EP | 2273077 | 1/2011 |

* cited by examiner

CAMSHAFT ADJUSTER

The present invention relates to a camshaft adjuster, for example of the vane cell type, for driving and/or adjusting a camshaft of an internal combustion engine, including a stator and a concentric rotor rotatably situated within the stator, at least the stator having a central receptacle for accommodating the camshaft. Moreover, the present invention relates to a camshaft adjuster-camshaft combination which includes a camshaft adjuster according to the present invention and a camshaft. Lastly, the present invention relates to a method for installing the camshaft adjuster-camshaft combination.

BACKGROUND

A camshaft adjuster of this type is known from DE 10 2012 223 582 A1, for example, relating to a camshaft adjuster system which includes a camshaft adjuster and a camshaft, the camshaft adjuster including a drive element and an output element situated so that it is pivotable with respect to the drive element, the output element being connected to the camshaft in a rotatably fixed manner, a cover element being rotatably fixedly fastened to the output element and the hub of the cover element being situated between the drive element and the camshaft, the radial direction of extension of the cover element being greater than the diameter of the contact surface of the cover element with respect to the camshaft.

Gas exchange valves of internal combustion engines may be actuated by cams of a camshaft. The opening and closing times of the gas exchange valves are settable in a targeted manner via the configuration and shape of the cams. The camshaft is generally actuated, driven, and/or controlled by the crankshaft of the internal combustion engine. The opening and closing times of the gas exchange valves of the internal combustion engine are generally specified by a relative rotational position or phase position or angular position between the cams and the crankshaft. As the result of a relative change in this relative rotational position between the camshaft and the crankshaft, a variable adjustment of the opening and closing times of the gas exchange valves may be achieved. Due to the variable adjustment of the opening and closing times of the gas exchange valves, for example the exhaust gas characteristics may be positively influenced, the fuel consumption may be reduced, the efficiency may be increased, and/or the maximum torque and/or the maximum power of the internal combustion engine may be increased as a function of the instantaneous operating state of the internal combustion engine.

This variable adjustment of the opening and closing times of the gas exchange valves may be made, or made possible, by a provided camshaft adjustment device or unit or such a camshaft adjuster between the crankshaft and the camshaft.

For this purpose, a camshaft adjuster is generally provided in the kinematic chain between the crankshaft and the camshaft. A portion of the camshaft adjuster, referred to below as the stator, is rotatably fixedly connected to the crankshaft. Another portion of the camshaft adjuster, referred to below as the rotor, is rotatably fixedly connected to the camshaft. A gear is customarily provided between the stator and the rotor. For a hydraulic camshaft adjuster of the vane cell type, this gear is generally provided as a hydraulically actuated vane cell or as a plurality of such vane cells. The variable adjustment of the opening and closing times of the gas exchange valves may be achieved by the action of hydraulic pressure on the vane cells. This embodiment may also be referred to as a rotary piston adjuster. However, it is pointed out here that the present invention is not limited to camshaft adjusters of the vane cell type, and that in principle, other types of camshaft adjusters may also be used.

A camshaft adjuster is generally centered for installation on the particular camshaft via a cylindrical surface that extends in an axial direction of the camshaft. In DE 10 2012 223 582 A1, this is referred to, for example, as the hub of the cover element. Providing this cylindrical surface has disadvantages. It is thus necessary for this cylindrical surface to have a certain axial extension, also referred to as a centering depth, and therefore installation space in the camshaft adjuster is required. This installation space or this volume is therefore no longer available for other design measures, such as providing a borehole. A large amount of installation space is also necessary overall, which is undesirable on its own. Another disadvantage is that the camshaft adjuster is subject to being adjusted during installation; for example, an angular position or a phase position may be set, or a belt drive, a chain drive, or the like may be set or mounted on the adjuster, while the camshaft adjuster is not secured against slipping or coming off in the axial direction.

SUMMARY OF THE INVENTION

It is an object of the present invention to eliminate or at least mitigate the disadvantages from the prior art, and in particular to save installation space in the camshaft adjuster. Moreover, an alternate or additional object of the present invention is to secure the camshaft adjuster against falling down/coming apart during installation, preferably during setting or during the setting phase during installation. It is desirable to provide the camshaft adjuster or the camshaft adjuster-camshaft combination using little design effort or low material expenditure and/or in a cost-effective manner, and to reduce the installation effort.

The present invention provides that at least one radially inwardly protruding projection is present on a radial inner edge of the central receptacle for engaging behind a radially outwardly protruding web of the camshaft. The installation space necessary for this purpose is thus limited to the axial and radial extensions of the projection, so that installation space may thus be saved. A form fit is created by engaging behind the web with the projection. The engagement from behind may also be referred to as an undercut, or is based on an undercut.

Advantageous specific embodiments are described in greater detail below.

It may thus be provided that in/with a planned installation orientation, the projection is provided on a section opposite from gravity or the force of gravity, i.e., for an installation position at an upper section of the radially inner edge of the central receptacle. The projection thus engages behind the web, and is securely held in position by the force of gravity. The camshaft adjuster may thus be prevented from axially slipping or coming off axially, in a particularly reliable manner.

If the projection is indicated by a marking, such as an impression, which is also visible during installation, an installer may ensure the position of the projection more easily, and thus may install the individual parts more quickly, precisely, and cost-effectively.

The advantage of securing the camshaft adjuster against axially slipping or coming off axially is achieved particularly efficiently when the projection is prepared for axially engaging behind the web, for example with regard to material and/or geometry.

With regard to installation space, it is particularly advantageous for the projection to be formed by the stator, for example integrally, in one piece or multiple pieces. For example, the stator may include a cover on the camshaft side, so that the projection is formed by the cover of the stator. As a refinement, it may be provided that the cover is a sheet metal part, and in particular that the cover is a punched part. If the cover is a punched part, the projection may be formed in a way that is neutral with respect to manufacturing costs.

It may be provided that the projection extends in the circumferential direction only in sections, as the result of which material, weight, and thus costs may be saved.

It is advantageous for the rotor to be prepared for centering on the web, since by the installation step of engaging behind the web with the aid of the projection, at the same time the rotor may thus be centered with respect to the camshaft, thus saving an installation step. As a refinement, it may be provided that the rotor has an inner contour that is prepared for centering on the web, for example with regard to geometry and/or material.

With the aid of a central valve that is accommodatable in the rotor, the rotor may also be prepared for being centered on the camshaft. The rotor may thus be centered on the camshaft by accommodation or insertion of the central valve in the rotor. In this way, the centering may be ensured in a particularly reliable manner, and/or an installation step, for example the centering, may be spared.

During installation, the camshaft adjuster may be axially secured to the camshaft in a particularly reliable manner when a detent for axially securing, preferably detachably, the camshaft adjuster to the camshaft is provided on the camshaft adjuster in the area of the central receptacle. According to one refinement, the detent may be provided at the radial inner edge of the central receptacle, so that the detent is spatially fixable to the projection with a (single) manufacturing step. If the projection is provided only in sections in the circumferential direction, with regard to lever forces to be applied it is advantageous when the detent is provided on a section of the central receptacle opposite from the projection.

If the camshaft adjuster is axially rotatably fixedly securable to the camshaft with the aid of the central valve, particularly reliable fixing of the camshaft adjuster to the camshaft may be achieved over the service life of the camshaft adjuster.

Moreover, the present invention relates to a camshaft adjuster-camshaft combination which includes a camshaft adjuster of the type according to the present invention, and a camshaft having the radially protruding web.

As a refinement, it may be provided that the camshaft adjuster-camshaft combination includes the central valve.

Moreover, the present invention relates to a method for installing the camshaft adjuster on the camshaft, and/or a method for installing the camshaft adjuster-camshaft combination, the method including the following steps: placing the projection on the camshaft, preferably axially on the camshaft side of the web, the camshaft adjuster preferably being pivoted by a predetermined angle $\alpha$ with respect to the camshaft about the contact site, and pivoting the camshaft adjuster about the contact site, so that the camshaft adjuster is in approximate alignment with the camshaft in the longitudinal direction (i.e., axially). The camshaft adjuster may thus be installed on the camshaft using two partial work steps, making use of an installation space advantage.

To achieve particularly reliable operation of the camshaft adjuster, it may also be provided that the method has the following step after the pivoting: securing the camshaft adjuster to the camshaft in the axial direction, the securing preferably involving mounting the central valve on the camshaft, for example also by rotatably fixedly connecting the two modules to one another.

BRIEF DESCRIPTION OF THE DRAWINGS

The present invention is described below with reference to multiple specific embodiments.

DETAILED DESCRIPTION

Figure 1:
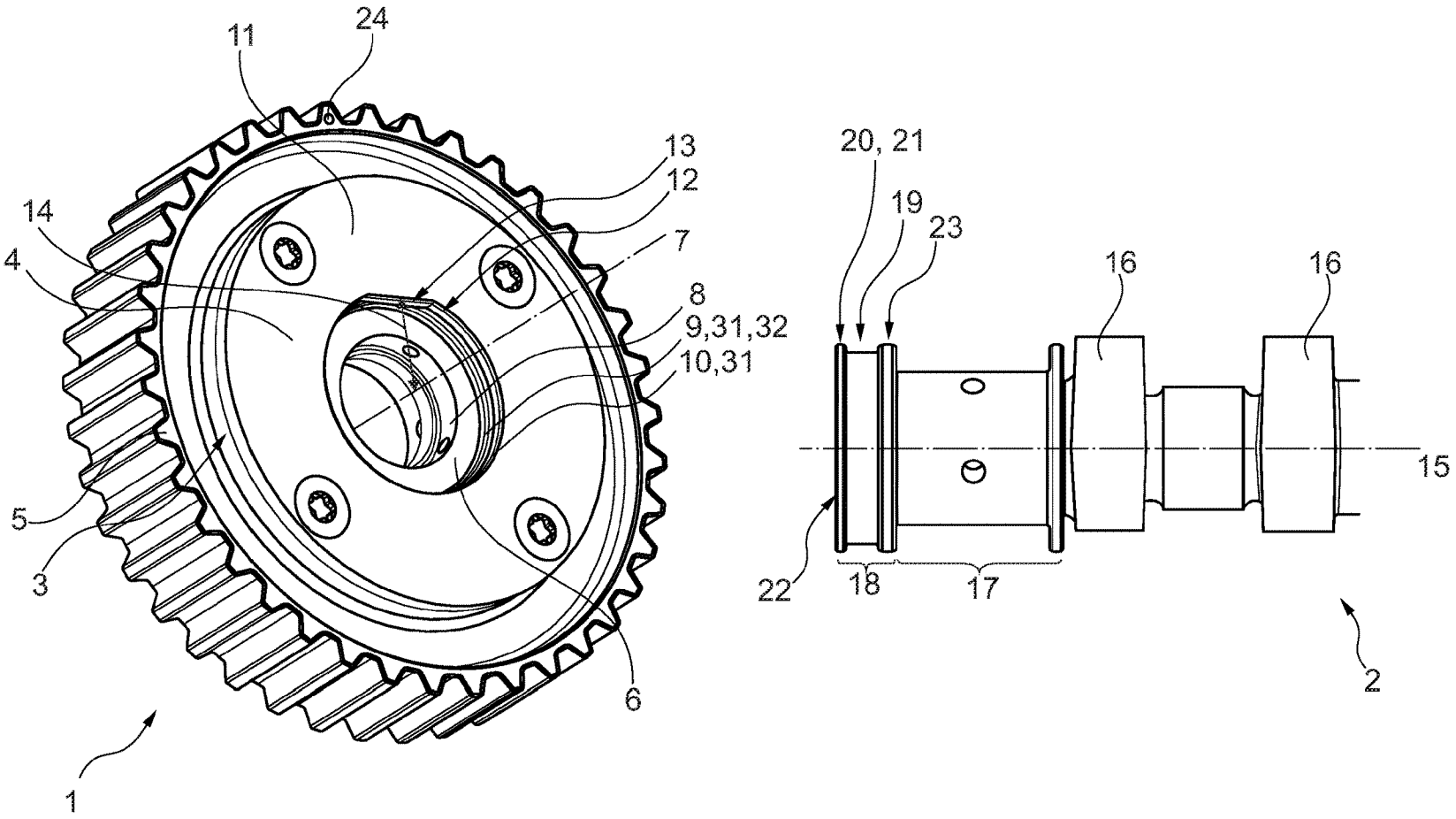
FIG. 1 shows a top view onto a camshaft adjuster and a portion of a camshaft according to a first specific embodiment of the present invention, in a state prior to installation.

The figures are merely schematic, and are used only for an understanding of the present invention. Identical or comparable elements are provided with the same reference numerals, and may be exchanged with one another and are thus exchangeable.

FIG. 1 shows a camshaft adjuster 1 and a camshaft 2 in a state prior to installation. This means that in this state, camshaft adjuster 1 and camshaft 2 have an arbitrary orientation with respect to one another.

Camshaft adjuster 1 includes a stator 3 with a cover 4, and a stator housing 5 as well as a rotor 6. Rotor 6 is situated within stator 3 so that the rotor is pivotable relative to the stator. In addition, rotor 6 is situated concentrically with respect to stator 3. This means that rotor 6 and stator 3 have a shared longitudinal axis 7. Cover 4 may also be referred to as the stator cover, as the camshaft adjuster cover, or as the adjuster cover. Longitudinal axis 7 may be referred to as camshaft adjuster longitudinal axis 7 or, as in the following discussion, as adjuster longitudinal axis 7.

An essentially cylindrical inner contour 8 and a cylindrical accommodation area 9 are formed (radially) centrally in rotor 6. An inner diameter at an inner edge of accommodation area 9 may also be referred to as centering diameter 32 of rotor 6/camshaft adjuster 1. Inner contour 8 and accommodation area 9 together form a through hole through rotor 6. An opening 10 is provided in stator 3. More precisely, opening 10 is formed in cover 4. In the present case, accommodation area 9 and opening 10 together form a central receptacle 31 for accommodating camshaft 2 in camshaft adjuster 1. In the first specific embodiment, central receptacle 31 is thus formed by stator 3 and rotor 6.

Opening 10, accommodation area 9, and inner contour 8 are lined up in this sequence along adjuster longitudinal axis 7, beginning with a stator front side 11 of camshaft adjuster 1 defined by cover 4. Stator front side 11 may also be referred to as the cover front side, as the camshaft adjuster front side, as the adjuster front side or, as in the following discussion, as the front side.

Opening 10 has an inner edge 12 whose diameter is at least equal to the diameter of accommodation area 9, or preferably greater than the diameter of accommodation area 9. Opening 10 also has a projection 13. Projection 13 adjoins inner edge 12 in the circumferential direction around adjuster longitudinal axis 7. Projection 13 is formed in sections in the circumferential direction; i.e., projection 13 does not completely surround adjuster longitudinal axis 7 in the circumferential direction. A minimum distance 14 from adjuster longitudinal axis 7 to projection 13 is smaller than the radius of accommodation area 9. In other words, viewed from inner edge 12 and from accommodation area 9, projection 13 protrudes radially inwardly in each case. Projection 13 and accommodation area 9 thus form an undercut, viewed from stator front side 11. Inwardly protruding projection 13 is elevated with respect to the diameter of opening 10, and therefore may also be referred to as an elevation.

Camshaft 2 has a longitudinal axis 15. Longitudinal axis 15 may also be referred to as the camshaft longitudinal axis, or as the shaft longitudinal axis for short. A plurality of cams 16, at least one camshaft bearing area 17, and a retaining section 18 are formed on camshaft 2. A cylindrical clearance 19 is formed on retaining section 18 of camshaft 2. A web 20, which may also be referred to as a nose, protrudes or extends radially outwardly from clearance 19. An outer diameter 21 of web 20 may also be referred to as a centering diameter.

Retaining section 18, camshaft bearing area 17, and cams 16 follow one another along longitudinal axis 15, starting from a front side 22 of camshaft 2. Front side 22 may also be referred to as the camshaft front side or as the shaft front side. Web 20 axially adjoins front side 22 of camshaft 2. It is particularly advantageous for web 20 to directly adjoin front side 22, since this arrangement takes up little installation space in camshaft adjuster 1. A further web 23 may be formed at one end of clearance 19 at a distance from web 20, as shown in FIGS. 1 through 4. Web 20 and clearance 19 form an undercut, viewed from front side 22.

A marking 24 is provided radially outwardly on stator front side 11, viewed from adjuster longitudinal axis 7—in the present case, in the radial direction behind projection 13. Marking 24 is impressed with the aid of a punch, for example.

Of course, marking 24 may also be provided at some other location if desired. However, it is advantageous to position marking 24 in such a way that projection 13 is at the top during the installation. Due to the fact that rotor 6 and stator 3 can rotate with respect to one another, it is also advantageous to provide marking 24 rotatably fixed with respect to projection 13; i.e., since projection 13 is formed on stator 3 in the present case, marking 24 is also provided on stator 3. To even further reduce the effort in assembling stator 3, the marking may be present on the same component as projection 13; i.e., since projection 13 is formed on cover 4, marking 24 may be provided on cover 4.

Figure 3:
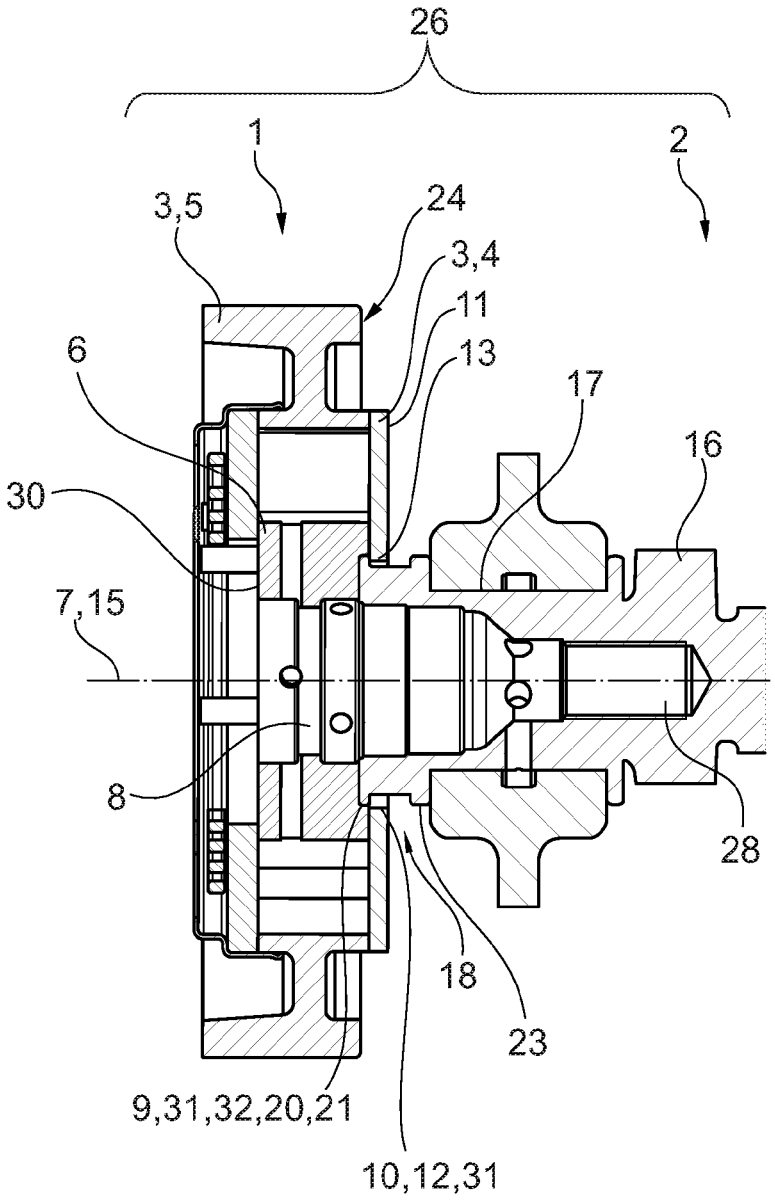
FIG. 3 shows a longitudinal section of the camshaft adjuster and the portion of the camshaft from FIG. 1 in a subsequent state during the installation, compared to the state shown in FIG. 2.
Figure 4:
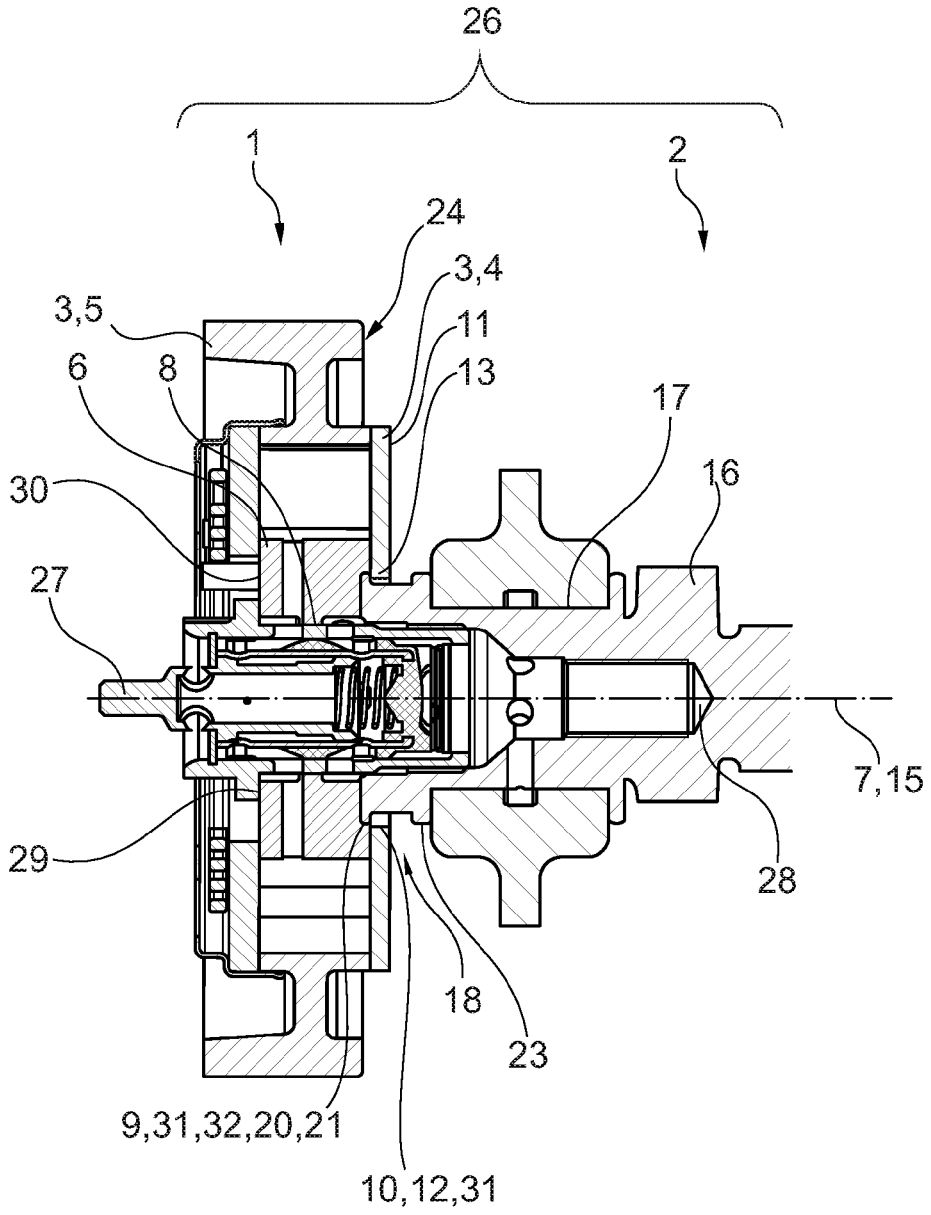
FIG. 4 shows a longitudinal section of the camshaft adjuster and the portion of the camshaft from FIG. 1 in a state after completion of installation, with a central valve mounted.

Installation of camshaft adjuster 1 on camshaft 2 is described below with reference to FIGS. 2 through 4. It is assumed that camshaft 2 is positioned on an internal combustion engine (not illustrated), and supported on the at least one camshaft bearing area 17, for example.

Stator front side 11 is initially oriented toward front side 22 of camshaft 2, so that front sides 11, 22 point approximately toward one another. It should be ensured that marking 24 is at the top, viewed in the direction of the force of gravity or in the direction of gravity. In front of or at the camshaft, camshaft adjuster 1 is then tipped or pivoted by an angle $\alpha$ about the horizontal, so that preferably no further area of camshaft adjuster 1 is situated opposite from projection 13 in the direction of gravity. Next, projection 13 is placed axially on web 20 on the camshaft side, or on clearance 19. This step may also be referred to as "threading" camshaft 2 into camshaft adjuster 1. For this threading, it is particularly advantageous for the diameter of inner edge 12 to be greater than centering diameter 32.

Figure 2:
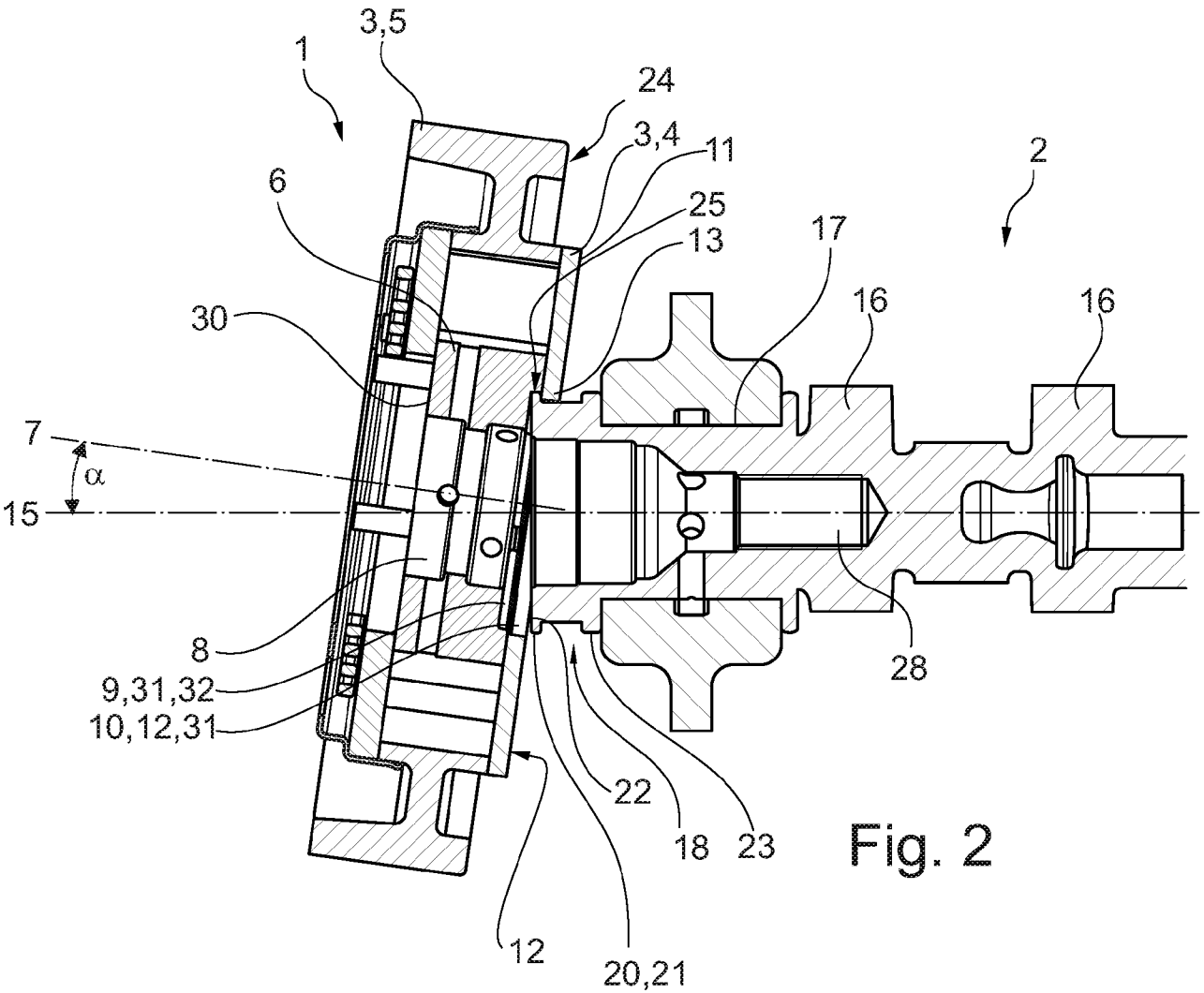
FIG. 2 shows a longitudinal section of the camshaft adjuster and the portion of the camshaft from FIG. 1, in a state at the start of installation.

This results in the state shown in FIG. 2 during the installation. This state (based on time or on the time sequence) may be referred to as the partial installation state, as the intermediate installation step, or, since camshaft adjuster 1 rests against camshaft 2, as the contact state.

The location at which camshaft adjuster 1 rests against camshaft 2 in this state during the installation is referred to below as contact site 25. Next, camshaft adjuster 1 is pivoted backwards about contact site 25 by angle $\alpha$, so that adjuster longitudinal axis 7 is aligned with shaft longitudinal axis 15.

After pivoting, camshaft adjuster 1 is in an installation position with respect to camshaft 2. This state is illustrated in FIG. 3. It is apparent in FIG. 3 that in the present case, accommodation area 9 and opening 10 form central receptacle 31 according to the claims. Camshaft adjuster 1 and camshaft 2 form a camshaft adjuster-camshaft combination 26.

Camshaft adjuster 1 is now centered on outer diameter 21 of camshaft 2 via centering diameter 32. It must be ensured that in a state after the installation of camshaft adjuster 1 and camshaft 2, projection 13 is rotatable relative to camshaft 2, in particular relative to web 20 and/or to clearance 19. It is particularly preferred when projection 13 is rotatable relative to camshaft 2 without scraping against clearance 19 or without rubbing on the surface of camshaft 2.

As a result, web 20 engages behind projection 13 in a form-locked manner, thus ensuring that, according to the object of the present invention, camshaft adjuster 1 does not come off during mounting on camshaft 2. However, rotor 6 is not yet rotatably fixedly connected to camshaft 2, so that, for example, an angle between camshaft 2 and rotor 6 is easily settable, or, for example, a belt or a chain (neither of which is illustrated) is easily mountable on stator 3 for connection to a crankshaft (not illustrated). In particular, the simultaneous presence of the secured state of camshaft adjuster 1 on camshaft 2, and the rotatability between rotor 6 and camshaft 1, facilitates the installation.

Camshaft adjuster 1 is secured to camshaft 2 in an operationally secure manner in a further installation step. For this purpose, a central valve 27 is inserted axially through inner contour 8, accommodation area 9, and opening 10 into a valve receptacle 28 that is formed in camshaft 2. Central valve 27 is screwed into valve receptacle 28 with the aid of a thread pair, for example (not illustrated). In the process, a front side 29 of central valve 27 comes into contact with a further front side 30 of camshaft adjuster 1. Front side 29 of central valve 27 may also be referred to as the central valve front side or as the valve front side. Front side 30 of camshaft adjuster 1 is preferably formed on rotor 6, and may be referred to as the (further) camshaft adjuster front side, as the adjuster front side, or as the rotor front side.

Camshaft adjuster 1 is thus secured against coming off camshaft 2 during the installation, and stator 3 is prevented from scraping against camshaft 2 in the operative state.

Another specific embodiment of the present invention is not illustrated in the figures, but is described below. In the second specific embodiment, a detent or a plurality of detents is provided at inner edge 12. The detents are situated at inner edge 12, opposite from projection 13. The detents are dimensioned in such a way that they allow installation using detent forces that are typical for installation. More precisely, the detents allow the step of pivoting camshaft adjuster 1 resting against web 20 to be carried out using forces that are typical for installation. In particular, the detents prevent elimination of the pivoting, without exceeding predefined limiting forces. Even greater security against coming off is thus achieved during the further installation.

Yet another specific embodiment of the present invention, likewise not illustrated in the figures, is described briefly below. In the third specific embodiment, accommodation area 9 is formed not in rotor 6, but, rather, solely in stator 3, preferably solely in cover 4 of stator 3. In this specific embodiment, central receptacle 31 is thus formed only in stator 3. This means that the undercut of camshaft adjuster 1 is preferably formed only by cover 4. This has the advantage that a particularly large amount of installation space may be saved in rotor 6 and is available for other design measures. It is advantageous for the outer diameter of web 20 to be smaller than the inner diameter of accommodation area 9, to the extent that in an operative state, rubbing of stator 3 against camshaft 2 is prevented, the same as in the specific embodiments previously discussed. It is also advantageous for rotor 6 to be centered on camshaft 2 with the aid of central valve 27.

LIST OF REFERENCE NUMERALS

1 camshaft adjuster
2 camshaft
3 stator
4 cover
5 stator housing
6 rotor
7 adjuster longitudinal axis
8 inner contour
9 accommodation area
10 opening
11 front side of the stator
12 inner edge
13 projection
14 minimum distance between the adjuster longitudinal axis and the projection
15 longitudinal axis of the camshaft
16 cam
17 camshaft bearing area
18 retaining section
19 clearance
20 web
21 outer diameter of the web of the camshaft
22 front side of the camshaft
23 web
24 marking
25 contact site
26 camshaft adjuster-camshaft combination
27 central valve
28 valve receptacle
29 front side of the central valve
30 front side of the rotor
31 central receptacle
32 centering diameter of the camshaft adjuster
$\alpha$ angle

The invention claimed is:

1. A camshaft adjuster for driving a camshaft of an internal combustion engine, the camshaft adjuster comprising:

a stator; and a concentric rotor rotatably situated within the stator, the stator having a central receptacle for accommodating the camshaft defined by a radial inner edge, at least one radially inwardly protruding projection extending radially inward from the radial inner edge for engaging behind a radially outwardly protruding web of the camshaft.

2. The camshaft adjuster as recited in claim 1 wherein the projection is configured for axially engaging behind the web.

3. The camshaft adjuster as recited in claim 1 wherein the projection is formed by the stator.

4. The camshaft adjuster as recited in claim 1 wherein the rotor is configured for centering or for being centered on the web, or the rotor is prepared for being centered on the camshaft, with the aid of a central valve accommodatable in the rotor.

5. The camshaft adjuster as recited in claim 1 wherein a detent for axially securing the camshaft adjuster to the camshaft is provided on the camshaft adjuster in the area of the central receptacle.

6. The camshaft adjuster as recited in claim 1 wherein the camshaft adjuster is axially securable to the camshaft with the aid of the central valve.

7. A camshaft adjuster-camshaft combination comprising: the camshaft adjuster as recited in claim 1 and the camshaft having the radially protruding web, the projection engaging the radially protruding web with the radially protruding web between the projection and the rotor.

8. The camshaft adjuster as recited in claim 7 further comprising a central valve.

9. A method for installing the camshaft adjuster-camshaft combination as recited in claim 7, the method comprising the following steps:

axially placing the projection on the camshaft on a camshaft side of the web, the camshaft adjuster being pivoted by an angle with respect to the camshaft about a contact site; and pivoting the camshaft adjuster about the contact site, so that the camshaft adjuster is in axial alignment with the camshaft.

10. The method as recited in claim 9 further comprising, after the pivoting, securing the camshaft adjuster to the camshaft in an axial direction.

11. The camshaft adjuster as recited in claim 1, wherein the at least one radially inwardly protruding projection does not completely surround a longitudinal center axis of the camshaft adjuster in a circumferential direction.

12. The camshaft adjuster as recited in claim 1, wherein the at least one radially inwardly protruding projection has a flat inner surface.

13. The camshaft adjuster as recited in claim 1, wherein the at least one radially inwardly protruding projection adjoins an upper section of the radially inner edge.

14. The camshaft adjuster as recited in claim 1, wherein the at least one radially inwardly protruding projection has a different shape than the radial inner edge.

15. The camshaft adjuster as recited in claim 1, wherein the projection is configured for being rotatable relative to the camshaft.

16. The camshaft adjuster as recited in claim 15, wherein the projection is configured for being rotatable relative to the camshaft without scraping against a clearance formed on a retaining section of the camshaft or without rubbing on a surface of the camshaft.

17. The camshaft adjuster as recited in claim 1, wherein an outer diameter of the web is smaller than an inner diameter of an accommodation area forming the central receptacle of the rotor.

18. A method for installing a camshaft adjuster-camshaft combination comprising:

a camshaft adjuster comprising:

a stator; and a concentric rotor rotatably situated within the stator, the stator having a central receptacle for accommodating a camshaft, at least one radially inwardly protruding projection being present on a radial inner edge of the central receptacle for engaging behind a radially outwardly protruding web of the camshaft; and the camshaft having the radially protruding web, the projection engaging behind the web, the method comprising the following steps:

axially placing the projection on the camshaft on a camshaft side of the web, the camshaft adjuster being pivoted by an angle with respect to the camshaft about a contact site; and pivoting the camshaft adjuster about the contact site, so that the camshaft adjuster is in axial alignment with the camshaft.

19. The method as recited in claim 18 further comprising, after the pivoting, securing the camshaft adjuster to the camshaft in an axial direction.

* * * * *